US011647791B2

(12) United States Patent
Liu

(10) Patent No.: US 11,647,791 B2
(45) Date of Patent: May 16, 2023

(54) ELECTRONIC CIGARETTE

(71) Applicant: Tuanfang Liu, Shenzhen (CN)

(72) Inventor: Tuanfang Liu, Shenzhen (CN)

( * ) Notice: Subject to any disclaimer, the term of this patent is extended or adjusted under 35 U.S.C. 154(b) by 310 days.

(21) Appl. No.: 17/005,287

(22) Filed: Aug. 27, 2020

(65) Prior Publication Data

US 2021/0153557 A1 May 27, 2021

(30) Foreign Application Priority Data

Nov. 26, 2019 (CN) ..... 201911170162.9
Nov. 26, 2019 (CN) ..... 201922072933.2

(51) Int. Cl.
*A24F 40/485* (2020.01)
*A24F 40/46* (2020.01)
*A24F 40/42* (2020.01)
*A24F 40/10* (2020.01)

(52) U.S. Cl.
CPC ..... *A24F 40/485* (2020.01); *A24F 40/10* (2020.01); *A24F 40/42* (2020.01); *A24F 40/46* (2020.01)

(58) Field of Classification Search
CPC ..... A24F 40/42; A24F 40/485; A24F 40/10; A24F 40/46
See application file for complete search history.

(56) References Cited

U.S. PATENT DOCUMENTS

2015/0335075 A1* 11/2015 Minskoff ..... A24F 40/44 131/329
2016/0100633 A1* 4/2016 Gao ..... H05B 1/0244 131/329
2017/0325504 A1* 11/2017 Liu ..... A61M 11/042
2019/0216135 A1* 7/2019 Guo ..... A24F 40/44

* cited by examiner

*Primary Examiner* — Jean F Duverne
(74) *Attorney, Agent, or Firm* — Matthias Scholl P.C.; Matthias Scholl

(57) ABSTRACT

An electronic cigarette including an atomization assembly and a battery assembly. The atomization assembly includes an e-liquid storage tank and a limit cover disposed in the e-liquid storage tank, and the limit cover includes an air intake and an air passage. The e-liquid storage tank includes a side wall, a vertical air passage disposed along the side wall, and a bottom air passage communicating with the vertical air passage and the air intake of the limit cover. The side wall includes an air inlet communicating with the vertical air passage. When in use, air enters the atomization assembly via the air inlet, sinks along the vertical air passage and enters the bottom air passage of the atomization assembly, passes through the air intake of the limit cover, flows upwards in the air passage of the limit cover, and discharges from the top part of the atomization assembly.

7 Claims, 6 Drawing Sheets

ELECTRONIC CIGARETTE

CROSS-REFERENCE TO RELATED APPLICATIONS

Pursuant to 35 U.S.C. § 119 and the Paris Convention Treaty, this application claims foreign priority to Chinese Patent Application No. 201911170162.9 filed Nov. 26, 2019 and to Chinese Patent Application No. 201922072933.2 filed Nov. 26, 2019. The contents of all of the aforementioned applications, including any intervening amendments thereto, are incorporated herein by reference. Inquiries from the public to applicants or assignees concerning this document or the related applications should be directed to: Matthias Scholl P. C., Attn.: Dr. Matthias Scholl Esq., 245 First Street, 18th Floor, Cambridge, Mass. 02142.

BACKGROUND

The disclosure relates to an electronic cigarette.

Electronic cigarettes atomize nicotine-containing e-liquid.

Conventionally electronic cigarettes contain no memory foam. The condensate e-liquid deposits in the atomizer or even leaks out of the atomizer.

SUMMARY

The disclosure provides an electronic cigarette comprising an atomization assembly and a battery assembly. The atomization assembly is disposed on the battery assembly; the atomization assembly comprises an e-liquid storage tank and a limit cover disposed in the e-liquid storage tank, and the limit cover comprises an air intake and an air passage.

The e-liquid storage tank comprises a side wall, a vertical air passage disposed along the side wall, and a bottom air passage communicating with the vertical air passage and the air intake of the limit cover; and the side wall comprises an air inlet communicating with the vertical air passage.

When in use, air enters the atomization assembly via the air inlet, sinks along the vertical air passage and enters the bottom air passage of the atomization assembly, passes through the air intake of the limit cover, flows upwards in the air passage of the limit cover, and discharges from the top part of the atomization assembly.

The atomization assembly further comprises a memory foam, a heating wire, and a fixed seat; the memory foam is wrapped around the heating wire and disposed in the fixed seat.

The heating wire is horizontally disposed in the memory foam.

The atomization assembly further comprises a gasket seal; and the fixed seat is disposed on the gasket seal.

The battery assembly comprises a control panel and a silicone pad; the control panel is provided with a pneumatic switch disposed in the silicone pad; the silicone pad comprises a curve air passage connected to the pneumatic switch; when in use, the air flows through the curve air passage to drive the pneumatic switch to work.

DETAILED DESCRIPTION

To further illustrate, embodiments detailing an electronic cigarette are described below. It should be noted that the following embodiments are intended to describe and not to limit the disclosure.

Figure 1:
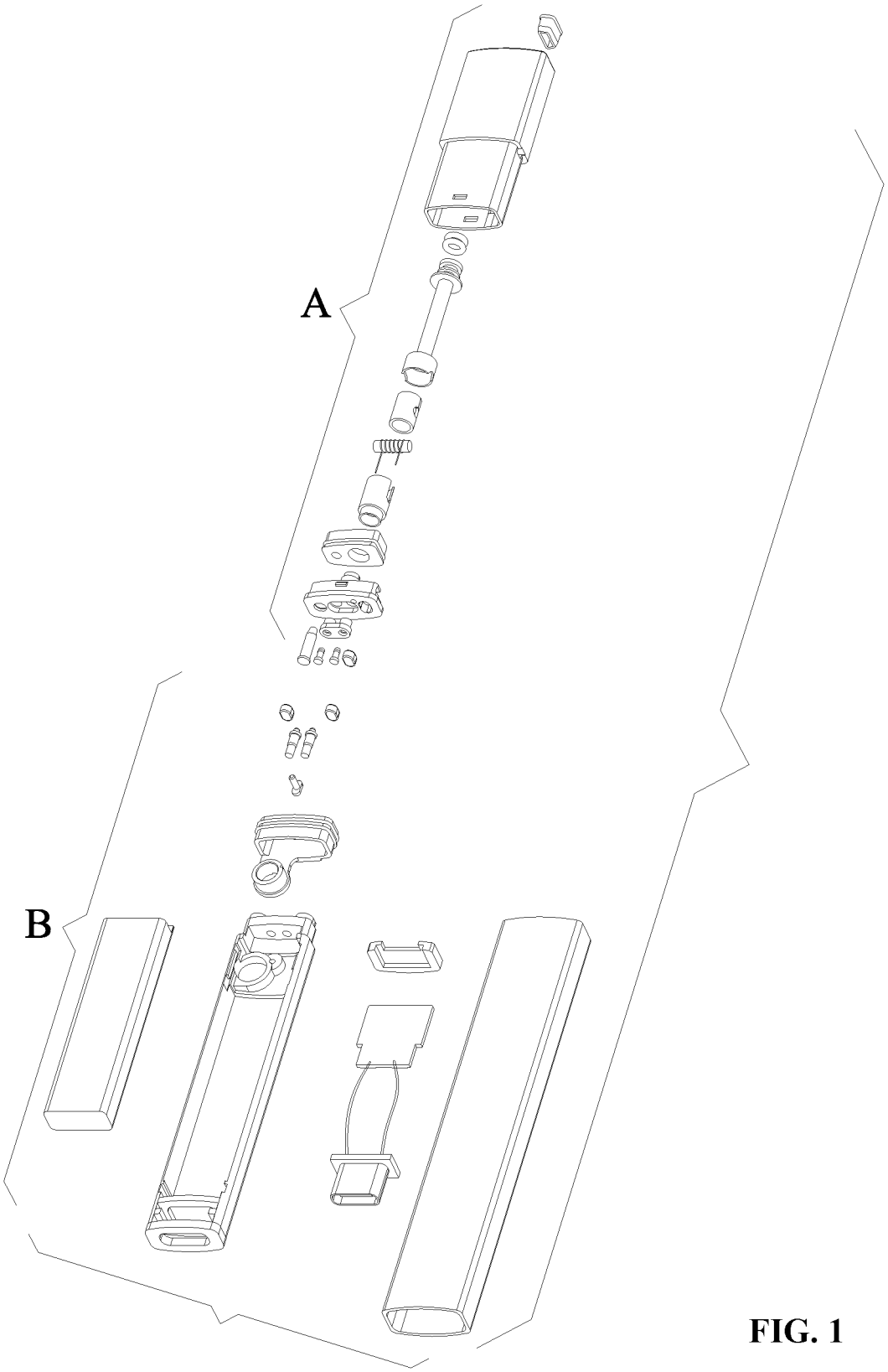
FIG. 1 is an exploded view of an electronic cigarette according to one embodiment of the disclosure.
Figure 2:
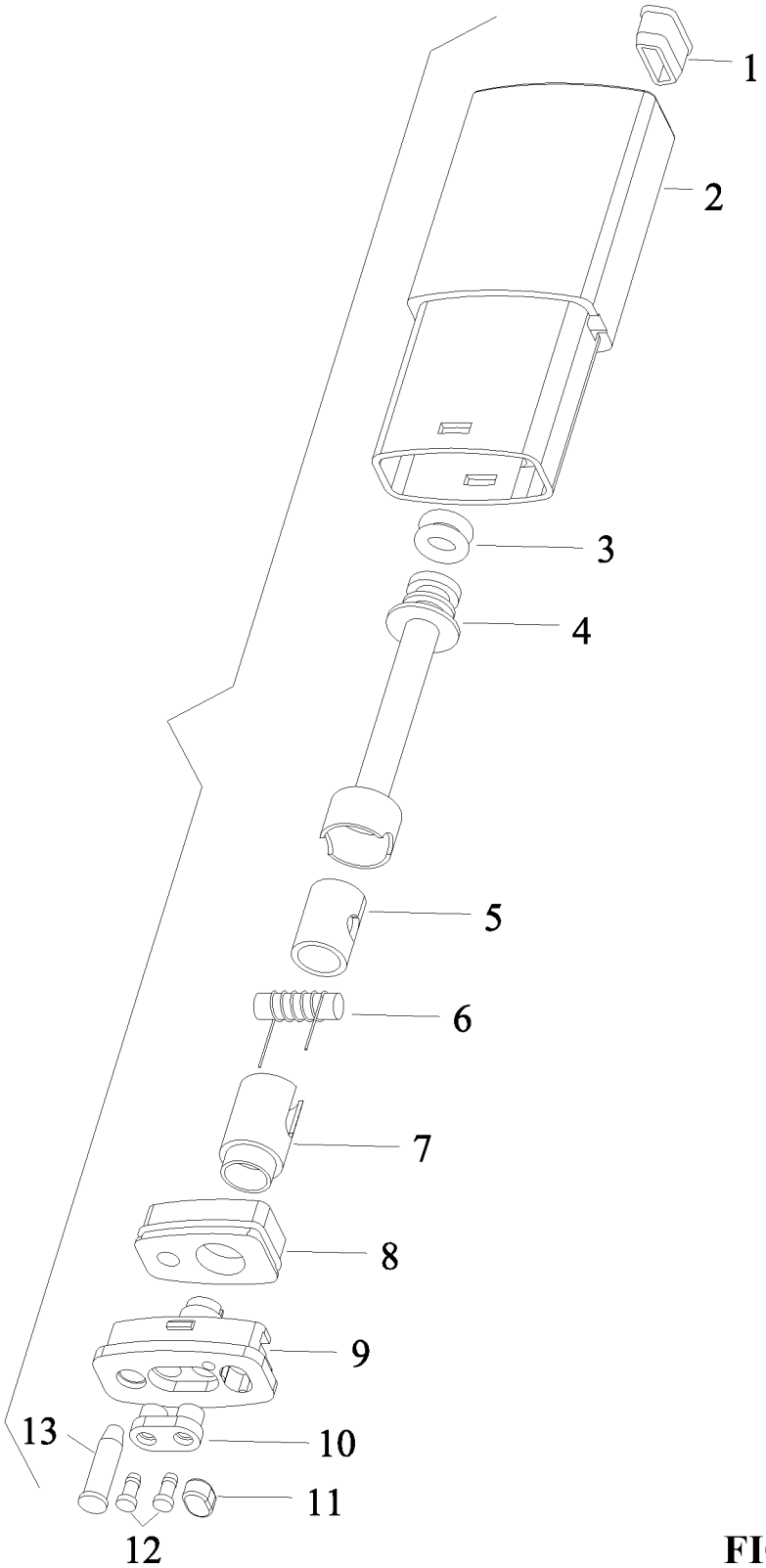
FIG. 2 is an exploded view of an atomization assembly of an electronic cigarette in FIG. 1.
Figure 3:
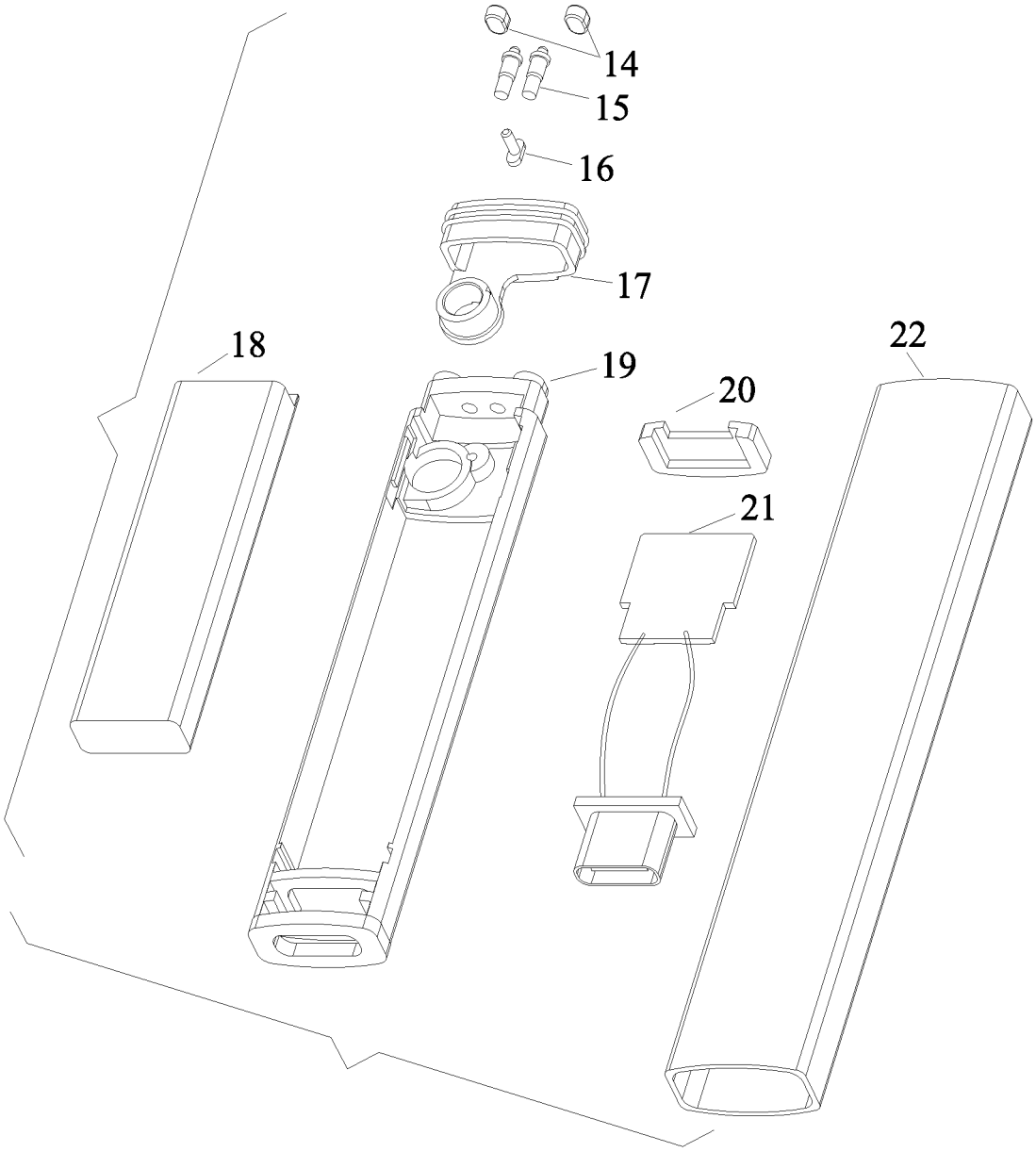
FIG. 3 is an exploded view of a battery assembly of an electronic cigarette in FIG. 1.
Figure 4:
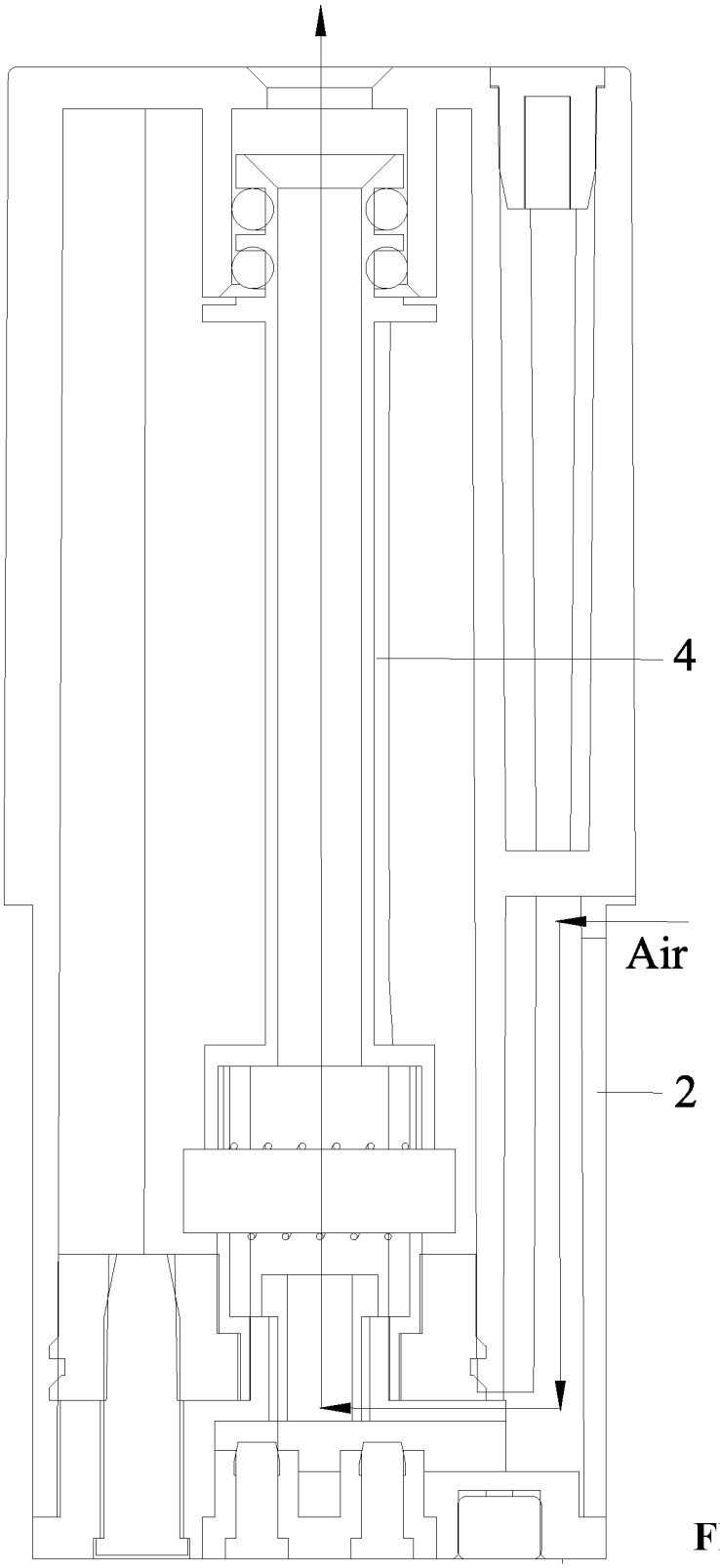
FIG. 4 is a sectional view of an electronic cigarette in FIG. 1.
Figure 5:
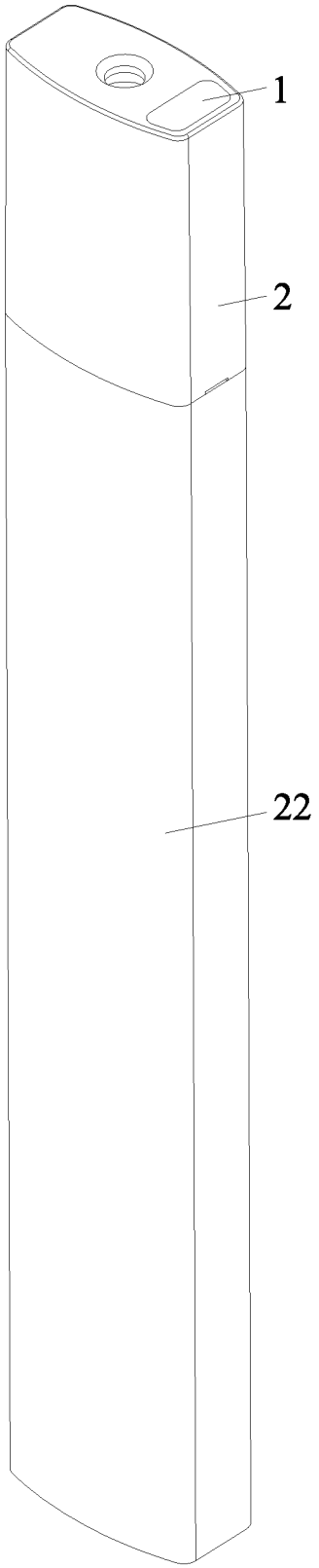
FIG. 5 is a schematic diagram of an electronic cigarette according to one embodiment of the disclosure.
Figure 6:
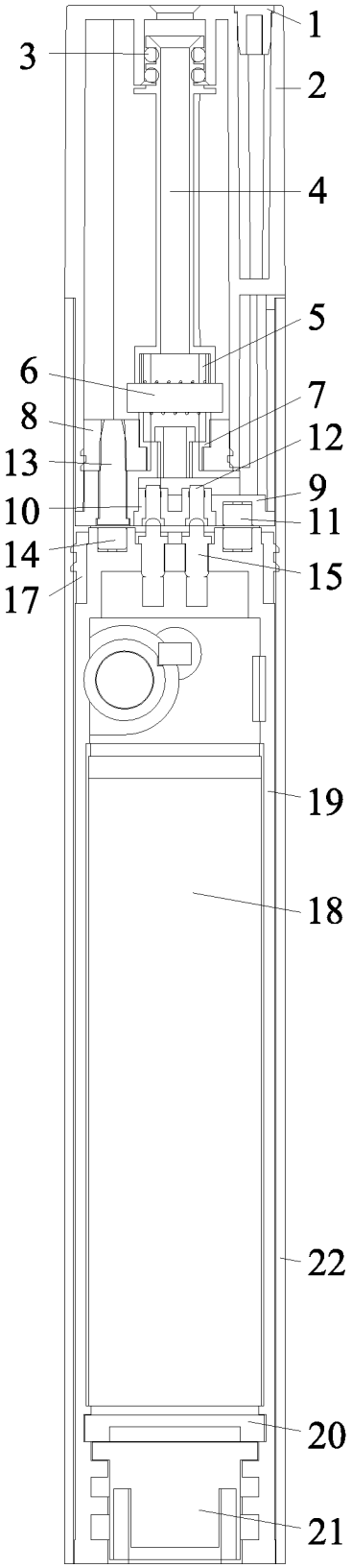
FIG. 6 is another sectional view of an electronic cigarette according to one embodiment of the disclosure.

As shown in FIGS. 1-6, an electronic cigarette comprises an atomization assembly A and a battery assembly B. The atomization assembly is disposed on the battery assembly. The atomization assembly A comprises an e-liquid storage tank 2 and a limit cover 4 disposed in the e-liquid storage tank 2, and the limit cover comprises an air intake and an air passage. The e-liquid storage tank 2 comprises a side wall, a vertical air passage disposed along the side wall, and a bottom air passage communicating with the vertical air passage and the air intake of the limit cover; and the side wall comprises an air inlet communicating with the vertical air passage. When in use, air enters the atomization assembly via the air inlet, sinks along the vertical air passage and enters the bottom air passage of the atomization assembly, passes through the air intake of the limit cover 4, flows upwards in the air passage of the limit cover 4, and discharges from the top part of the atomization assembly.

In this way, the vertical air passage is disposed on one side of the atomizer assembly. The airflow enters the vertical air passage from one side of the atomizer assembly, sinks to the bottom of the atomizer assembly, flows upwards in the air passage of the limit cover 4, and discharges from the top part of the atomization assembly. The entire air passage is a U-shaped structure, and can prevent the leakage of the e-liquid.

The atomization assembly further comprises a memory foam 5, a heating wire 6, and a fixed seat 7; the memory foam 5 is wrapped around the heating wire 6 and disposed in the fixed seat 7. Preferably, the heating wire 6 is horizontally disposed in the memory foam 5. More preferably, the atomization assembly further comprises a gasket seal 8; and the fixed seat 7 is disposed on the gasket seal 8.

The memory foam of the atomization assembly can absorb the condensate at the upper end and the e-liquid deposited on the lower end of the atomization assembly, and the absorbed condensed e-liquid can be reused for the heating wire.

As an improvement, the battery assembly comprises a control panel 21 and a silicone pad 17; the control panel 21 is provided with a pneumatic switch disposed in the silicone pad 17; the silicone pad 17 comprises a curve air passage connected to the pneumatic switch; when in use, the air flows through the curve air passage to drive the pneumatic switch to work.

Specifically, the electronic cigarette comprises a plug 1, an e-liquid storage tank 2, a seal ring 3, a limit cover 4, a memory foam 5, a heating wire 6, a fixed seat 7, a gasket seal 8, a basal seat 9, an insulation ring 10, a first magnet 11, a joint 12, and a seal plug 13.

The plug 1 is disposed on the top part of the e-liquid storage tank 2. The heating wire 6 is horizontally disposed in the memory foam 5, and the memory foam 5 is wrapped around the heating wire 6. The memory foam 5 is disposed in the fixed seat 7. The fixed seat 7 is disposed on the gasket seal 8. The gasket seal 8 is disposed on the basal seat 9. The insulation ring 10 is disposed in the basal seat 9. The joint 12 is disposed in the insulation ring 10. The seal ring 3 is wrapped around the limit cover 4. The limit cover 4 is disposed on the top part of the fixed seat to fix the memory foam 5. The basal seat 9 is disposed on one end of the e-liquid storage tank 2. The first magnet 11 and the seal plug 13 are disposed in the basal seat 9.

The vertical air passage is disposed on one side of the e-liquid storage tank 2. The airflow enters the vertical air passage from one side of the e-liquid storage tank 2, sinks to the bottom of the atomizer assembly, flows upwards in the air passage of the limit cover 4, and discharges from the top part of the atomization assembly. The entire air passage is a U-shaped structure, and the condensate e-liquid cannot flow out of the e-liquid storage tank 2, thus preventing the leakage of the e-liquid.

The battery assembly B comprises a second magnet 14, a spring pin 15, a light guide column 16, a silicone ring 17, a battery cell 18, a support 19, a baffle 20, a control panel 21, and a shell 22. The second magnet 14, the spring pin 15, and the silicone ring 17 are disposed on the top part of the support 19. The positive and negative electrodes of the control panel 21 are welded to the spring pin 15, and the input end positive and negative electrodes are welded to the battery cell 18. The battery cell 18 is disposed in the support 19 and fixed by the baffle 20. The support 19 is disposed in the shell 22. The atomization assembly is connected to the battery assembly through the magnetic attraction of the first magnet and the second magnet.

The following advantages are associated with the electronic cigarette of the disclosure:

1. the vertical air passage is disposed on one side of the atomizer assembly. The airflow enters the vertical air passage from one side of the atomizer assembly, sinks to the bottom of the atomizer assembly, flows upwards in the air passage of the limit cover, and discharges from the top part of the atomization assembly. The entire air passage is a U-shaped structure, and can prevent the leakage of the e-liquid.

2. The memory foam of the atomization assembly can absorb the condensate at the upper end and the e-liquid deposited on the lower end of the atomization assembly, and the absorbed condensed e-liquid can be reused for the heating wire.

3. The silicone pad comprises a curve air passage connected to the pneumatic switch; when in use, the air flows through the curve air passage to drive the pneumatic switch to work.

It will be obvious to those skilled in the art that changes and modifications may be made, and therefore, the aim in the appended claims is to cover all such changes and modifications.

What is claimed is:

1. An electronic cigarette, comprising: an atomization assembly and a battery assembly; the atomization assembly being disposed on the battery assembly; the atomization assembly comprising an e-liquid storage tank and a limit cover disposed in the e-liquid storage tank, and the limit cover comprising an air intake and an air passage;

wherein:

the e-liquid storage tank comprises a side wall, a vertical air passage disposed along the side wall, and a bottom air passage communicating with the vertical air passage and the air intake of the limit cover; and the side wall comprises an air inlet communicating with the vertical air passage;

when in use, air enters the atomization assembly via the air inlet, sinks along the vertical air passage and enters the bottom air passage of the atomization assembly, passes through the air intake of the limit cover, flows upwards in the air passage of the limit cover, and discharges from a top part of the atomization assembly; and the atomization assembly further comprises a memory foam, a heating wire, and a fixed seat; the memory foam is wrapped around the heating wire and disposed in the fixed seat.

2. The electronic cigarette of claim 1, wherein the heating wire is horizontally disposed in the memory foam.

3. The electronic cigarette of claim 1, wherein the atomization assembly further comprises a gasket seal; and the fixed seat is disposed on the gasket seal.

4. The electronic cigarette of claim 1, wherein the battery assembly comprises a control panel and a silicone pad; the control panel is provided with a pneumatic switch disposed in the silicone pad; the silicone pad comprises a curve air passage connected to the pneumatic switch; when in use, the air flows through the curve air passage to drive the pneumatic switch to work.

5. The electronic cigarette of claim 1, wherein the battery assembly comprises a control panel and a silicone pad; the control panel is provided with a pneumatic switch disposed in the silicone pad; the silicone pad comprises a curve air passage connected to the pneumatic switch; when in use, the air flows through the curve air passage to drive the pneumatic switch to work.

6. The electronic cigarette of claim 3, wherein the battery assembly comprises a control panel and a silicone pad; the control panel is provided with a pneumatic switch disposed in the silicone pad; the silicone pad comprises a curve air passage connected to the pneumatic switch; when in use, the air flows through the curve air passage to drive the pneumatic switch to work.

7. An electronic cigarette, comprising: an atomization assembly and a battery assembly; the atomization assembly being disposed on the battery assembly; the atomization assembly comprising an e-liquid storage tank and a limit cover disposed in the e-liquid storage tank, and the limit cover comprising an air intake and an air passage;

wherein:

the e-liquid storage tank comprises a side wall, a vertical air passage disposed along the side wall, and a bottom air passage communicating with the vertical air passage and the air intake of the limit cover; and the side wall comprises an air inlet communicating with the vertical air passage;

when in use, air enters the atomization assembly via the air inlet, sinks along the vertical air passage and enters the bottom air passage of the atomization assembly, passes through the air intake of the limit cover, flows upwards in the air passage of the limit cover, and discharges from a top part of the atomization assembly; and the battery assembly comprises a control panel and a silicone pad; the control panel is provided with a pneumatic switch disposed in the silicone pad; the silicone pad comprises a curve air passage connected to the pneumatic switch; when in use, the air flows through the curve air passage to drive the pneumatic switch to work.

* * * * *